US006427675B1

(12) United States Patent
Caldwell et al.

(10) Patent No.: US 6,427,675 B1
(45) Date of Patent: Aug. 6, 2002

(54) BALL PITCHING APPARATUS

(76) Inventors: Marcus L. Caldwell, 3120 Electra Dr. N., Colorado Springs, CO (US) 80906; Frederick L. Caldwell, 3116 Laurelhurst Dr., Rockford, IL (US) 61111

( * ) Notice: Subject to any disclaimer, the term of this patent is extended or adjusted under 35 U.S.C. 154(b) by 0 days.

(21) Appl. No.: 09/642,597

(22) Filed: Aug. 22, 2000

(51) Int. Cl.[7] ..... F41B 4/00
(52) U.S. Cl. ..... 124/78
(58) Field of Search ..... 124/78

(56) References Cited

U.S. PATENT DOCUMENTS 1,204,468 A * 11/1916 Marty ..... 124/78 X
3,538,900 A * 11/1970 Samuels ..... 124/78
4,197,827 A * 4/1980 Smith ..... 124/78
4,712,534 A * 12/1987 Nozato ..... 124/78

* cited by examiner

*Primary Examiner*—John A. Ricci

(74) *Attorney, Agent, or Firm*—G. F. Gallinger

(57) ABSTRACT

An improved ball pitching apparatus for a ball pitching machine of the type having an upper and lower wheel, said wheels rotating on substantially parallel shafts and having generally aligned and spaced rims carrying peripheral ball gripping bands; independent speed controlled drive motors; a ball feeder for feeding the ball between the spaced rims so that the ball will be gripped and accelerated in a trajectory tangential to the rims; a head frame carrying the wheels, drive motors, and ball feeder; and, a stand carrying the head frame. The improvements comprise: 1) a singular gripping band on one wheel and two spaced gripping bands on the other wheel so that the ball contacts and is gripped by three discrete points on its peripheral surface; 2) one of the wheels rotating on a shaft biased towards the other wheel so that the ball to be pitched will be gripped with a similar force regardless of diameter variations; and, 3) wheel drive DC motors internally positioned within the wheel so that the shafts and bearings in the motors are directly and radially loaded when the ball is gripped and accelerated. Internally driven wheels facilitate microprocessor and programmed memory control of a servo motors to control rotation of the head frame on the stand. This arrangement enables quick and precise adjustment to different pitching positions.

12 Claims, 2 Drawing Sheets

BALL PITCHING APPARATUS

FIELD OF THE INVENTION

This invention relates to baseball pitching machines. More particularly this invention relates to an improved pitching machine having ball grips positioned to match a grip used by a pitcher. A top side portion of the ball is held by two grips; the other bottom side portion of the ball is held by a single grip. This arrangement facilitates laterally spinning a ball; and coupled with a floating wheel which more consistently squeezes varying ball diameters, results in a ball pitching apparatus which can throw varying pitches more consistently within the strike zone.

BACKGROUND OF THE INVENTION

U.S. Pat. No. 4,197,827 issued to T. L. Smith on Apr. 15, 1980 discloses a ball pitching apparatus which utilizes a spinning upper and lower wheel. Each wheel utilizes an elastomer peripheral concave surface to grip a ball which is accelerated when it is passed between the spinning wheels. The ball is accelerated to 60 plus mph in approximately 50 milliseconds as it passes between the wheels. One problem with the apparatus is that with varying ball diameters—balls vary in diameter as much as 1/10"—different balls are gripped or squeezed with varying force; and consequently, they are accelerated between the wheels to widely varying speeds. Another problem with T. L. Smith's apparatus is that these machines are very time consuming to set up and tune to pitch in the strike zone. After a machine has been set up and tuned its setting is not varied. In order to pitch different curves and speeds it is necessary to set up several different ball pitching apparatuses. One for each type of pitch desired. One problem with this is that a batter is able to consistently anticipate the same type of pitch, say fast balls while practicing batting before a particular machine.

Yet another problem with the existing pitching apparatuses is that they are excessively heavy. The apparatuses use two brushed DC motors which each rotate on an end portion of one of the upper and lower wheel shafts. There is a repeated and enormous twisting moment on the shafts as balls are instantaneously accelerated to speeds approaching 100 mph. The frame carrying the motors, the shafts and the bearings must all be very substantial to remain in precise alignment for accurate pitches with repeated heavy load. In practice the heavy machines are set up, tuned and never moved. The large space around them and extending to the batter is dedicated to use with the pitching apparatus.

OBJECTS OF THE INVENTION

It is an object of this invention to disclose a ball pitching apparatus having ball grips positioned to match a grip used by a pitcher. A top side portion of the ball is held by two grips; the other side portion of the ball is held by a single grip. A baseball is not quite spherical. The seams on the leather casing extend outwardly from its spherical inner portion approximately 1/8". When a pitcher grips a ball he holds the ball only with his index finger, his long finger, and his thumb. He aligns the end portions of his fingers over and behind the seams to better spin the ball so that its trajectory is curved. The three point grip best holds and supports a non spherical ball. If the ball is squeezed more tightly between his long finger and his thumb than between his index finger and his thumb, it will have more lateral spin. The resulting pitch will have more lateral curve.

In comparison a non spherical ball held by two points on opposite sides of its top portion and by two points on opposite sides of its bottom portion is not as well held and supported. It is like a 4 legged table on a non flat floor. Unlike a three legged table it may rock. And further when the ball is held by two gripping points on its bottom side portion—even if a seam falls directly beneath one of its top gripping points so that one lateral side of the ball is more squeezed than the other—the ball will not spin laterally—the bottom side portion of the ball, from one gripping point to the other, must turn at the same speed. The applicant has found that he may predictably vary lateral curve on pitches by loading the seams of the ball differently with respect to the gripping points.

It is an object of this invention to disclose an apparatus which will grip and squeeze marginally varying diameters of balls with uniform force. Different baseballs have different coverings and seams, used balls are softer than new balls, and diameters of gripped and squeezed balls may vary as much as 1/10". When one considers that the ball must be accelerated to as much as 100 mph in a brief 50 milliseconds as it passes and slips between two fast spinning wheels, how hard it is squeezed, and how much it slips, is critical to its acceleration. A mechanism which automatically squeezes balls of varying diameters with consistent force can accommodate and uniformly pitch new and used balls, as well as balls having different seam and overall dimensions consistently with adequate accuracy. This is a significant practical advantage.

It is yet a further object of this invention to disclose a baseball pitching apparatus which utilizes wheels having brushless internal DC drive motors. These motors may be more accurately controlled for speed than DC motors having brushes. Additionally, this arrangement loads a relatively short motor shaft centrally. Compared to a cantilevered loading arrangement the motor shaft and bearings may be much lighter and still adequately support repeated and substantial loading moment as balls are instantaneously accelerated to as much as 100 mph.

It is a final object of this invention to disclose a ball pitching which may not only more accurately pitch strikes, but which can pitch strikes having varying positions within the strike zone. With the use of a microprocessor which memorizes and controls different frame rotational positions, as well as wheel rotational speeds, it is possible to replace multiple pitching machines, each used to throw substantially different pitches, with a single machine.

One aspect of this invention provides for an improvement in a ball pitching apparatus having; an upper and lower wheel, said wheels rotating on substantially parallel shafts and having generally aligned and spaced rims carrying peripheral ball gripping means; independent speed controlled drive means for rotating each of the wheels in opposite directions; a ball feeder for feeding the ball between the spaced rims so that the ball will be gripped therebetween and accelerated in a trajectory generally tangential to the rims it is gripped between; a head frame carrying the wheels, drive means, and ball feeder; and, a stand carrying the head frame. The improvement comprises: a singular gripping band on one wheel and two spaced gripping bands on the other wheel so that the ball contacts and is gripped by a single contact area on one side of the ball and two separate contact areas on an opposite side of the ball. The ball is held and gripped by three discrete points on its peripheral surface.

Another aspect of this invention, in a pitching apparatus as described above, provides for the improvement comprising: one of the wheels rotating on a shaft biased towards the other wheel so that the ball to be pitched will be gripped with a similar force regardless of ball diameter variations, ball seam positioning between the wheels, or ball hardness.

Yet another aspect of this invention, in a pitching apparatus as described above, provides for the improvement comprising: wheel drive means which are DC motors internally positioned within the wheel so that the shafts and bearings in the motors are directly and radially loaded when the ball is gripped and accelerated and so that the frame, shafts, and bearings may be substantially lighter than if they need be designed to maintain the wheels in precise rigid alignment while bearing a repeated cantilevered load arising from the ball's acceleration. This results in a lighter and more compact frame head, which in turn facilitates portability, and rotational movement and control of the frame head on the stand.

Various other objects, advantages and features of this invention will become apparent to those skilled in the art from the following description in conjunction with the accompanying drawings.

FIGURES OF THE INVENTION

Figure 2:
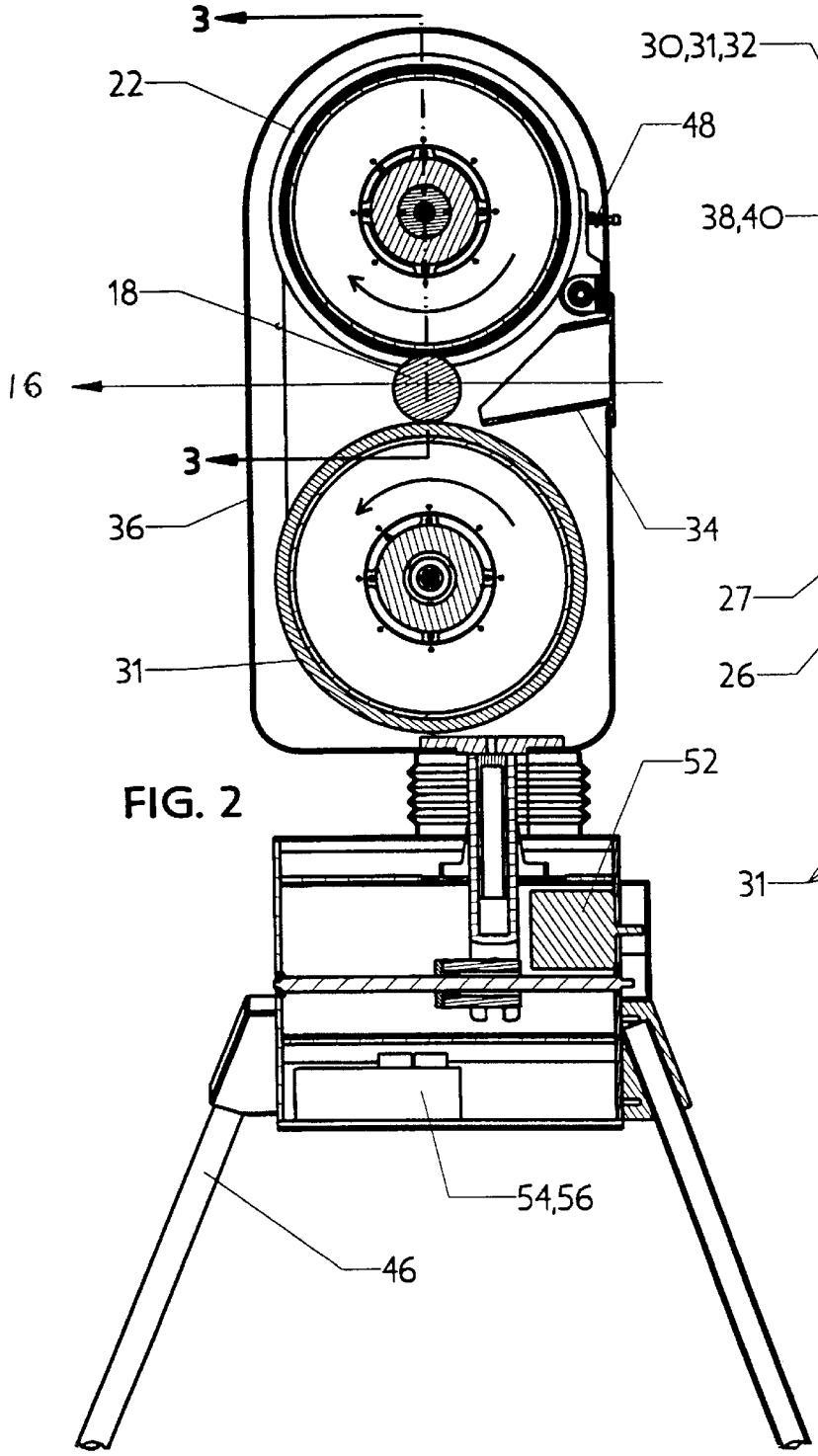
FIG. 2 is a cross sectional view of taken along line 2—2 on FIG. 1 of the frame head of the ball pitching apparatus.
Figure 3:
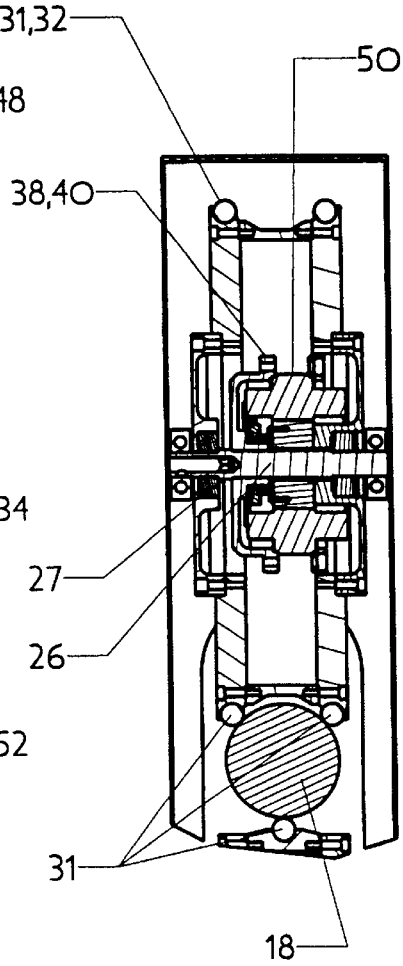

FIG. 3 i s a partial enlarged view of a top wheel showing a gripping means engaging a ball and an internal drive motor taken along line 3—3 on FIG. 2.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
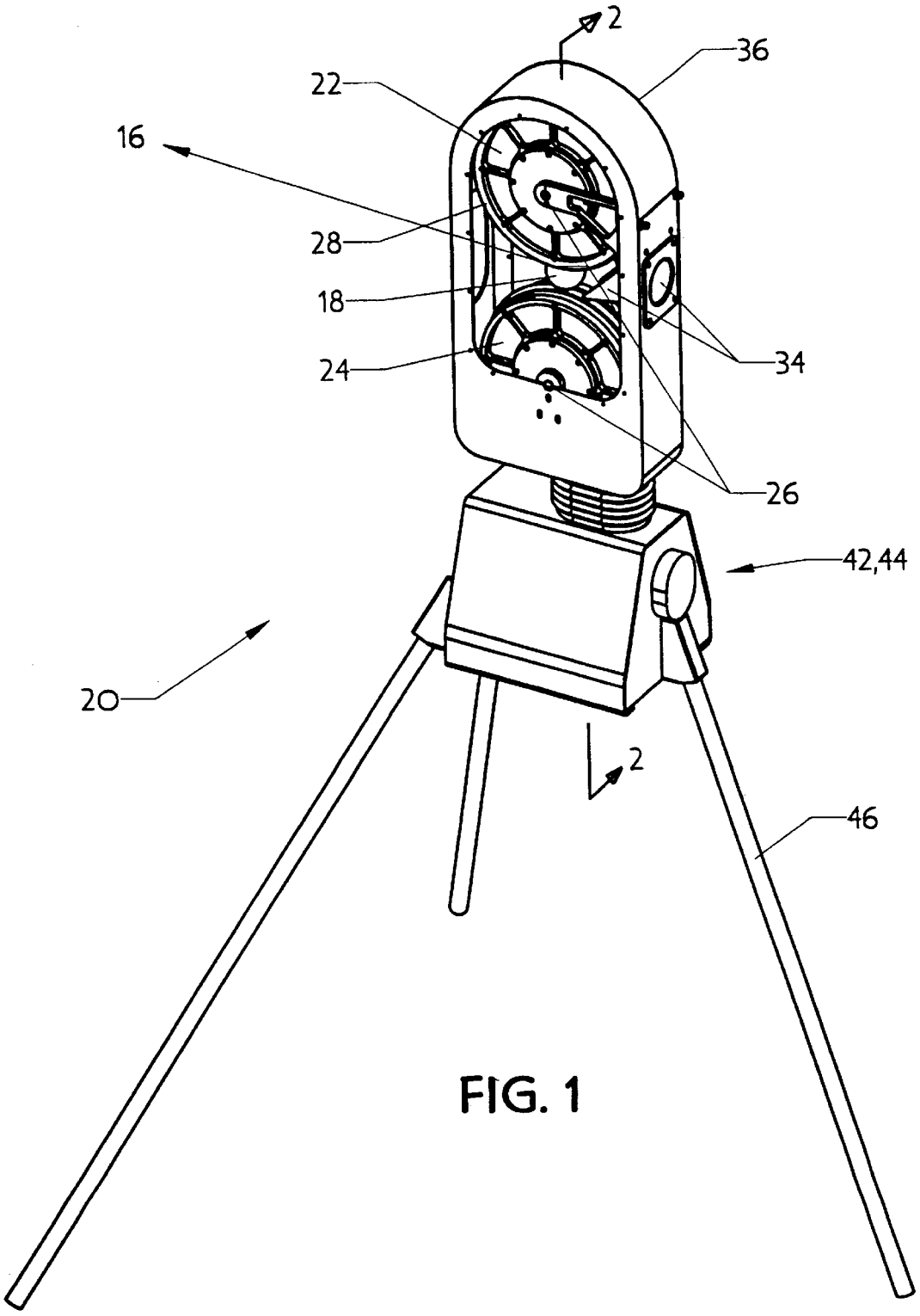
FIG. 1 is a perspective view of a ball pitching apparatus.

Turning now to the drawings and more particularly to FIG. 1 we have a perspective view of a ball pitching apparatus 20. The apparatus 20 for pitching a ball 18 is of the type comprising: an upper wheel 22 and a lower wheel 24, said wheels 22,24 rotating on substantially parallel shafts 26 and having generally aligned and spaced rims 28 carrying peripheral ball gripping means 30. Each of the wheels 22,24 have independent speed controls 42,44 and drive means 38 for rotation in opposite directions at different selected speeds. A ball feeder 34 for feeding the ball 18 between the rims 28 allows the ball 18 to be gripped between the rims 28 and accelerated in a trajectory 16 generally tangential to the points on the rims 28 it is gripped between. A head frame 36 carries the wheels 22,24, drive means 38, and ball feeder 34. A stand 46 carries the head frame 36.

One improvement to the ball pitching apparatus 20 comprises: a singular gripping band 31 on the lower wheel 24 and two spaced gripping bands 31 on the upper wheel 22 so that the ball 18 contacts and is gripped and held by three discrete points on its peripheral surface. When there are two gripping bands 31 around the upper wheel 22 and when there is a singular band 31 around the lower wheel 24 the grip on the ball 18 corresponds to the fingers on a pitcher's hand (not shown). In a preferred embodiment of the invention the gripping bands 31 have a width which is less than a fifth of the ball's 18 diameter. Most preferably the gripping bands 31 have a rounded peripheral face and comprise an O-rings 32.

FIG. 2 also shows a second substantial improvement to the ball pitching apparatus which is being used today. One of the wheels 22,24 rotating on shaft 26 is biased with a spring 48 towards the other wheel 24,22 so that the ball 18 to be pitched will be gripped with a similar force regardless of ball diameter variations, ball seam positioning between the wheels 22,24, or ball 18 hardness. This improvement results in more consistently accurate balls 18 being pitched from the ball pitching apparatus 20.

FIG. 2 is a cross sectional view taken along line 2—2 on FIG. 1 of the frame head 36 of the ball pitching apparatus 20. FIG. 3 is a partial enlarged view of FIG. 2. The top wheel 22 is shown gripping a ball 18 beneath O-rings 31. FIG. 3 best shows the preferred wheel drive means 38 which comprises DC motors 40 internally positioned within the wheels 22,24 so that the shafts 26 and bearings 27 therein are directly and radially loaded when the ball 18 is gripped and accelerated, and so that the head frame 36, shafts 26, and bearings 27 may be substantially lighter than if they had to be designed to maintain the wheels 22,24 in precise rigid alignment while bearing a repeated cantilevered load arising from the ball's 18 acceleration. Most preferably, the drive motors 40 have a stationary armature 50 and are brushless DC motors to facilitate more exact speed regulation thereof. The head frame 36 is rotatably (in x,y,and z planes) carried on the stand 46 and the rotation may be adjusted by servo motors 52. The servo motors 52 are controlled by a microprocessor 54 so that the head frame 36 may be automatic ally, precisely and quickly set up to a known position corresponding to a given pitch. The micro processor 54 further comprises memory 56 used to store co-ordinates of the frame head 36 rotation positions, as well as wheel 22,24 velocities for different pitches so that the ball pitching apparatus 20 can be automatically setup and quickly changed between different pitches. This control mechanism not only allows a single ball pitching apparatus 20 to replace multiple apparatuses 20, but additionally requires a batter to judge how to bat based on his perception of the ball's trajectory 16 when he is standing in front of a single ball pitching apparatus 20.

While the invention has been described with preferred specific embodiments thereof, it will be understood that this description is intended to illustrate and not to limit the scope of the invention, which is defined by the following claims.

What is claimed is:

1. In a pitching apparatus for pitching a ball having;

an upper and lower wheel, said wheels rotating on substantially parallel shafts and having generally aligned and spaced rims carrying peripheral ball gripping means;

independent speed controlled drive means for rotating each of the wheels in opposite directions;

a ball feeder for feeding the ball between the spaced rims so that the ball will be gripped therebetween and accelerated in a trajectory generally tangential to the rims it is gripped between;

a head frame carrying the wheels, drive means, and ball feeder; and, a stand carrying the head frame; the improvement comprising:

a singular gripping band on one wheel and two spaced gripping bands on the other wheel so that the ball contacts and is gripped by a single central contact area on one side of the ball and two separate contact areas on an opposite side of the ball so that the ball is held and gripped by three discrete points on its peripheral surface.

2. An apparatus as in claim 1 wherein the two gripping bands are around the upper wheel and wherein the singular band is around the lower wheel so that the grip on the ball corresponds to the fingers on a pitcher's hand.

3. An apparatus as in claim 2 further wherein the gripping bands have a width which is less than a third of the ball's diameter.

4. An apparatus as in claim 3 wherein the gripping bands have a width which is less than a fifth of the ball's diameter.

5. An apparatus as in claim 4 wherein the gripping bands have a rounded peripheral face.

6. An apparatus as in claim 5 wherein the gripping bands comprise an O-ring.

7. A pitching apparatus as in claim 1 wherein one of the wheels rotates on a shaft biased toward the other wheel so that the ball to be pitched will be gripped with a similar force regardless of ball diameter variations, ball seam positioning between the wheels, and ball hardness.

8. An apparatus as in claim 7 wherein the bias comprises a spring.

9. A pitching apparatus as in claim 1 further comprising wheel drive means which are DC motors internally positioned within the wheel so that the shafts and bearings in the motors are directly and radially loaded when the ball is gripped and accelerated and so that the frame, shafts, and bearings may be substantially lighter than if they were designed to maintain the wheels in precise rigid alignment while bearing a repeated cantilevered load arising from the ball's acceleration.

10. An apparatus as in claim 9 wherein the drive motors have a stationary armature and wherein the drive motors are brushless DC motors to facilitate more exact speed regulation thereof.

11. An apparatus as in claim 9 wherein the head frame is rotatably carried on the stand and wherein the rotation may be adjusted by servo motors and wherein the servo motors are controlled by a microprocessor so that the head frame may be automatically, precisely and quickly set up to a known position which corresponds to a given pitch.

12. An apparatus as in claim 11 further comprising a memory used to store co-ordinates of the frame head rotation positions, as well as wheel velocities for different pitches so that the ball pitching apparatus can be automatically setup and quickly changed between different pitches.

* * * * *